US005772536A

United States Patent [19]

Wang

[11] Patent Number: 5,772,536

[45] Date of Patent: Jun. 30, 1998

[54] BATTING PRACTICE DEVICE

[75] Inventor: Lian-Cheng Wang, Changhua Hsien, Taiwan

[73] Assignee: Cheng Lien Plastic Co., Ltd., Taipei, Taiwan

[21] Appl. No.: 802,172

[22] Filed: Feb. 19, 1997

[51] Int. Cl.[6] ..... A63B 69/40

[52] U.S. Cl. ..... 473/417

[58] Field of Search ..... 473/417, 422, 473/418

[56] References Cited

U.S. PATENT DOCUMENTS

| | | | |
|---|---|---|---|
| 3,858,878 | 1/1975 | Tassone | 473/417 |
| 4,191,372 | 3/1980 | Keller | 473/418 |
| 4,227,691 | 10/1980 | Lefebvre | 473/417 |
| 4,709,924 | 12/1987 | Wilson et al. | 473/417 |
| 4,796,885 | 1/1989 | Wright | 473/417 |
| 4,819,937 | 4/1989 | Gordon | 473/417 |
| 4,962,942 | 10/1990 | James | 473/417 |
| 5,004,234 | 4/1991 | Hollis | 473/417 |
| 5,076,580 | 12/1991 | Lang | 473/417 |
| 5,100,134 | 3/1992 | Becker | 473/417 |
| 5,415,396 | 5/1995 | Haung | 473/417 |

*Primary Examiner*—Theatrice Brown
*Attorney, Agent, or Firm*—Michaelson & Wallace; Peter L. Michaelson; John C. Pokotylo

[57] ABSTRACT

A batting practice device includes a base frame, a flexible tube having a lower portion fixedly mounted on the base frame, and a target object detachably mounted on the upper portion of the flexible tube.

5 Claims, 5 Drawing Sheets

BATTING PRACTICE DEVICE

FIELD OF THE INVENTION

The present invention relates to a batting practice device, and more particularly to a baseball batting practice device.

BACKGROUND OF THE INVENTION

A conventional baseball batting practice device is shown in FIG. 5, and there will be a complete illustration in the detailed description of the preferred embodiments.

The present invention has arisen to mitigate and/or obviate disadvantages of the conventional batting practice device.

SUMMARY OF THE INVENTION

In accordance with one aspect of the present invention, there is provided a batting practice device comprising a base frame, a flexible tube having a lower portion fixedly mounted on the base frame and an upper portion, and a target object detachably mounted on the upper portion of the flexible tube.

Further features of the present invention will become apparent from a careful reading of the detailed description with appropriate reference to the accompanying drawings.

DETAILED DESCRIPTION OF THE PREFERRED EMBODIMENTS

Figure 5:
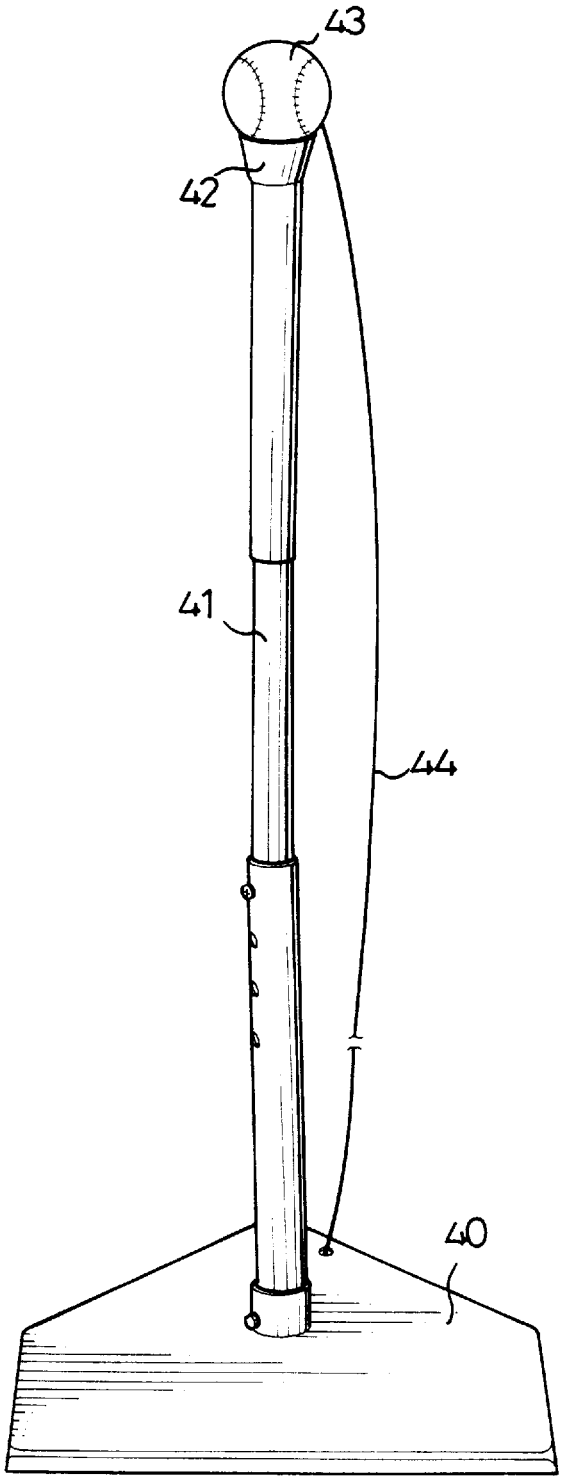
FIG.5 PRIOR ART
FIG. 5 is a perspective view of a conventional batting practice device in accordance with the prior art.

For a better understanding of features and benefits of the present invention, reference is made to FIG. 5 illustrating a conventional baseball batting practice device in accordance with the prior art.

The conventional baseball batting practice device comprises an upright post 41 having a lower portion fixedly mounted on a base frame 40, and an upper portion with a supporting base 42 for receiving a baseball 43 thereon, and a connecting wire 44 connected between the base frame 40 and the baseball 43.

By such an arrangement, however, the orientation of the baseball 43 is fixed due to a limitation of the upright post 41 which is limited to be adjusted along a vertical axis only, thereby decreasing the variability of practicing batting the baseball 43.

Figure 1:
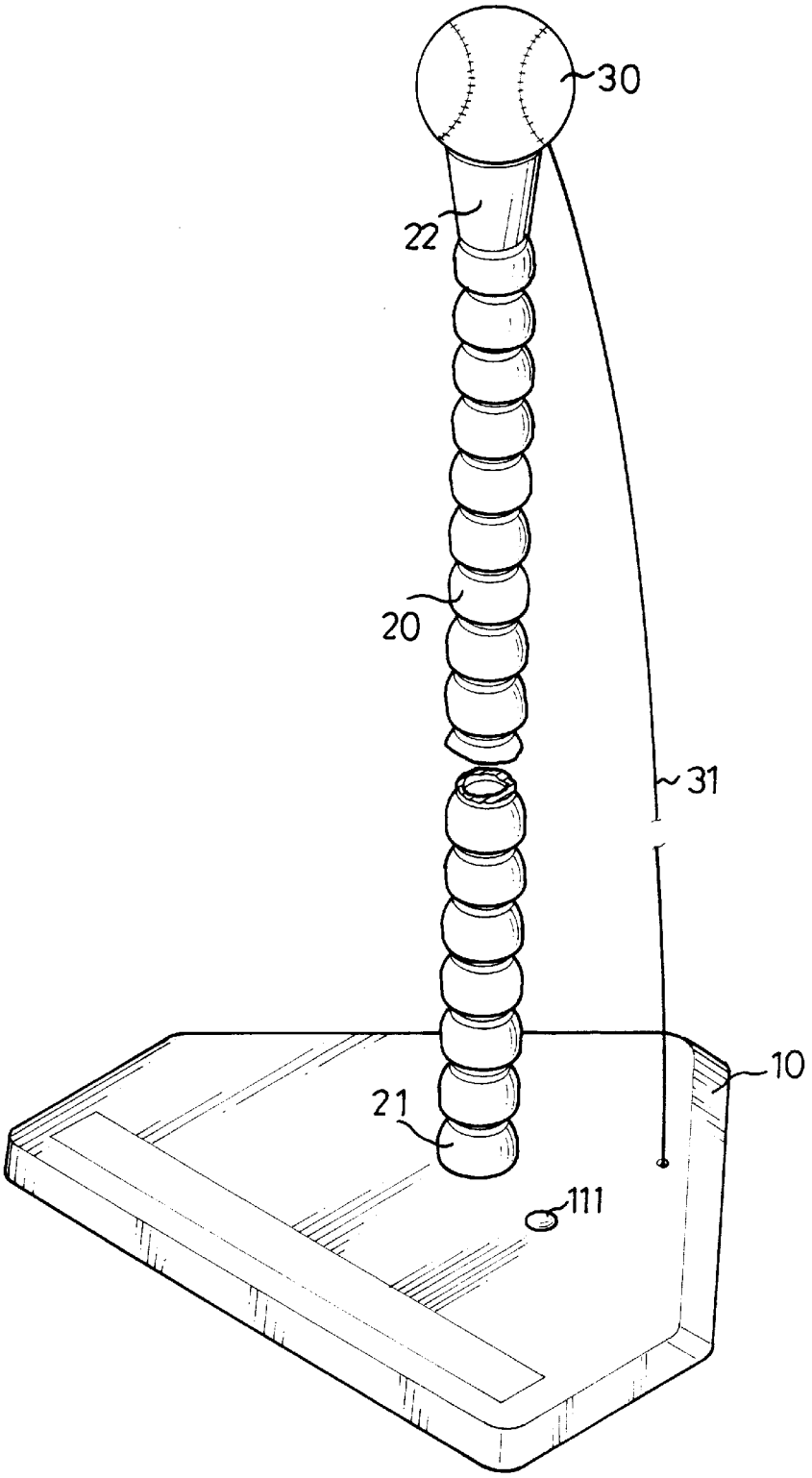
FIG. 1 is a partially cut-away perspective view of batting practice device in accordance with the present invention.

Referring now to FIG. 1, a batting practice device in accordance with the present invention can be provided for a user to practice batting a baseball and the like.

Figure 3:
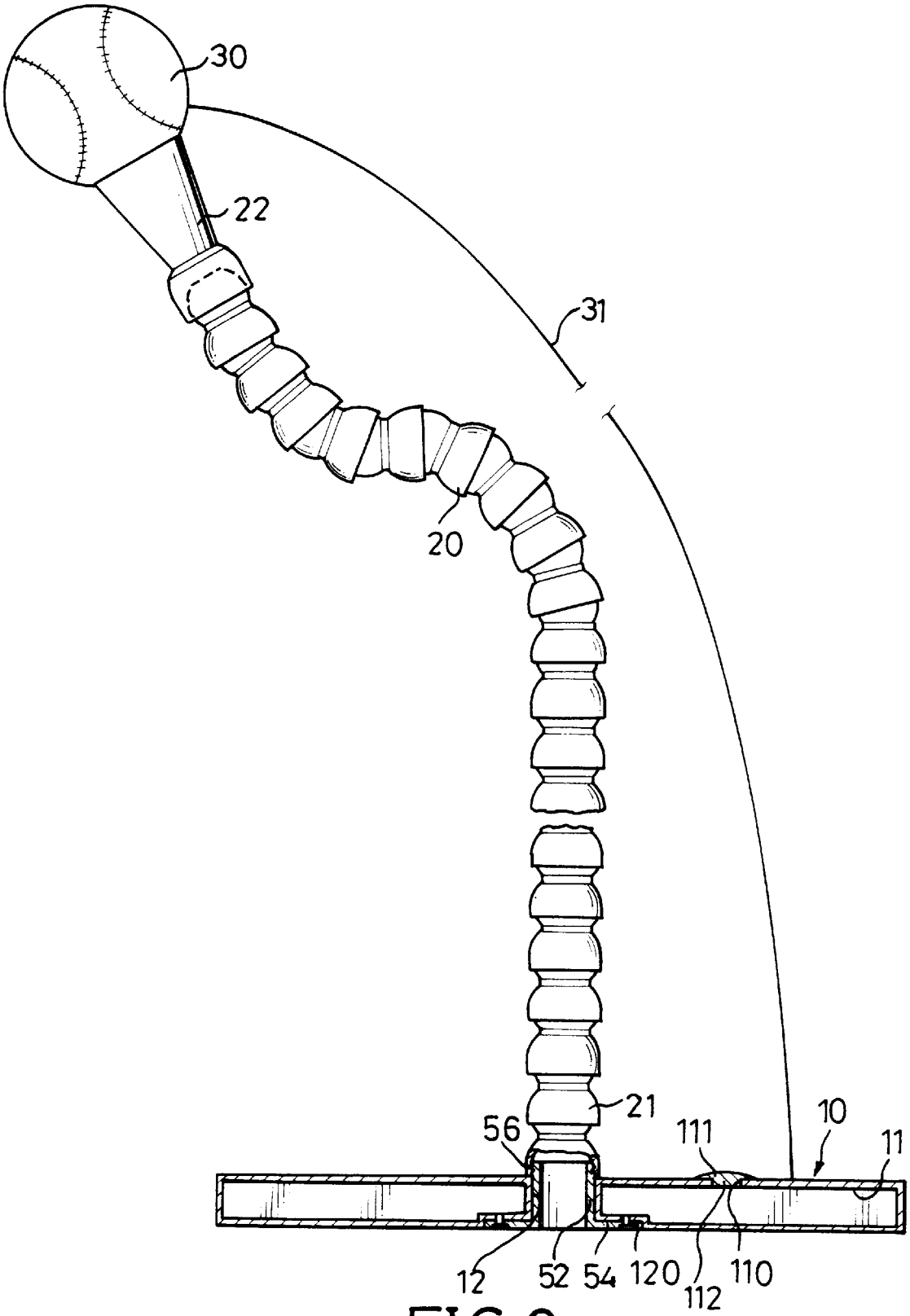
FIG. 3 is a front plan partially cross-sectional assembly view of FIG. 1.
Figure 4:
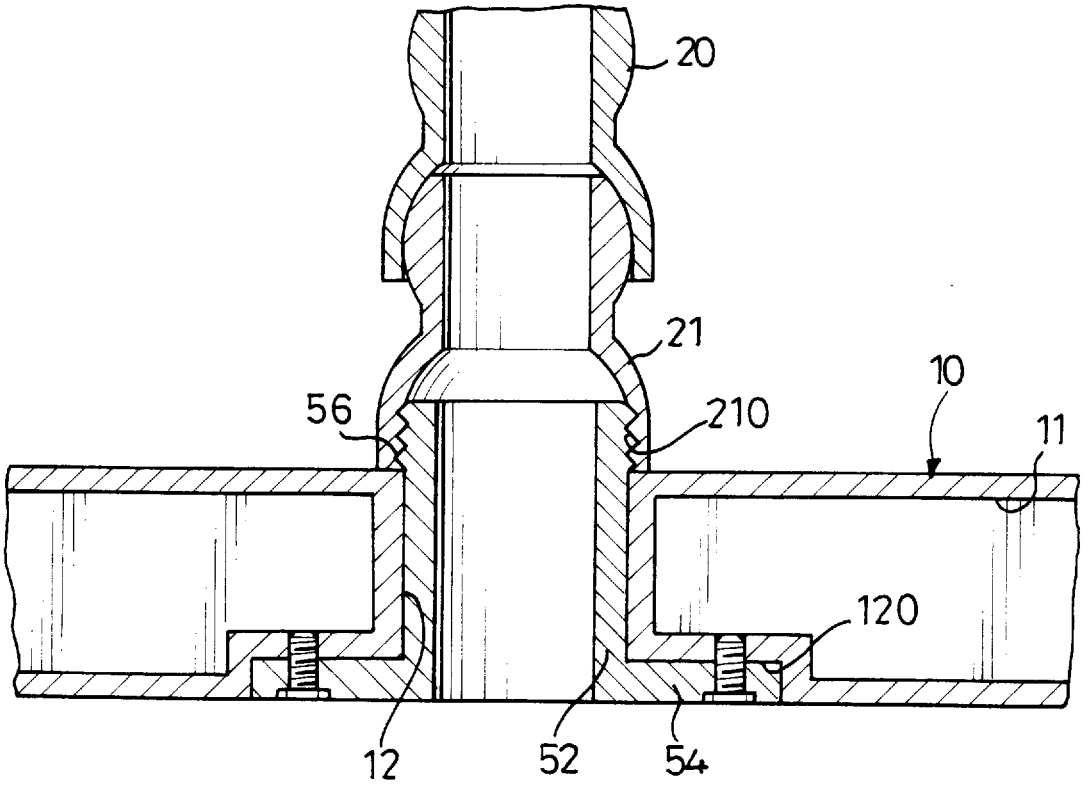
FIG. 4 is a partially enlarged view of FIG. 3.

The batting practice device comprises a base frame 10, a flexible tube 20 having a lower portion 21 fixedly mounted on the base frame 10 and an upper portion, and a target object such as a baseball 30 detachably mounted on the upper portion of the flexible tube 20. The flexible tube 20 is preferably a bellows-shaped tube. As shown in FIGS. 3 and 4, the flexible tube 20 includes a plurality of elements. Each of the elements of the tube 20 has a first end and a second end. The first end of each element has a convex, partial ball-shaped, outer surface. The second end of the element has a concave, socket-shaped, inner surface. The convex, partial ball-shaped, outer surface of the first end of one element, fits into the concave, socket-shaped, outer surface of the second end of an adjacent element. In this way, the tube 20 can be adjusted to assume many positions, one of which is depicted in FIG. 3.

Figure 2:
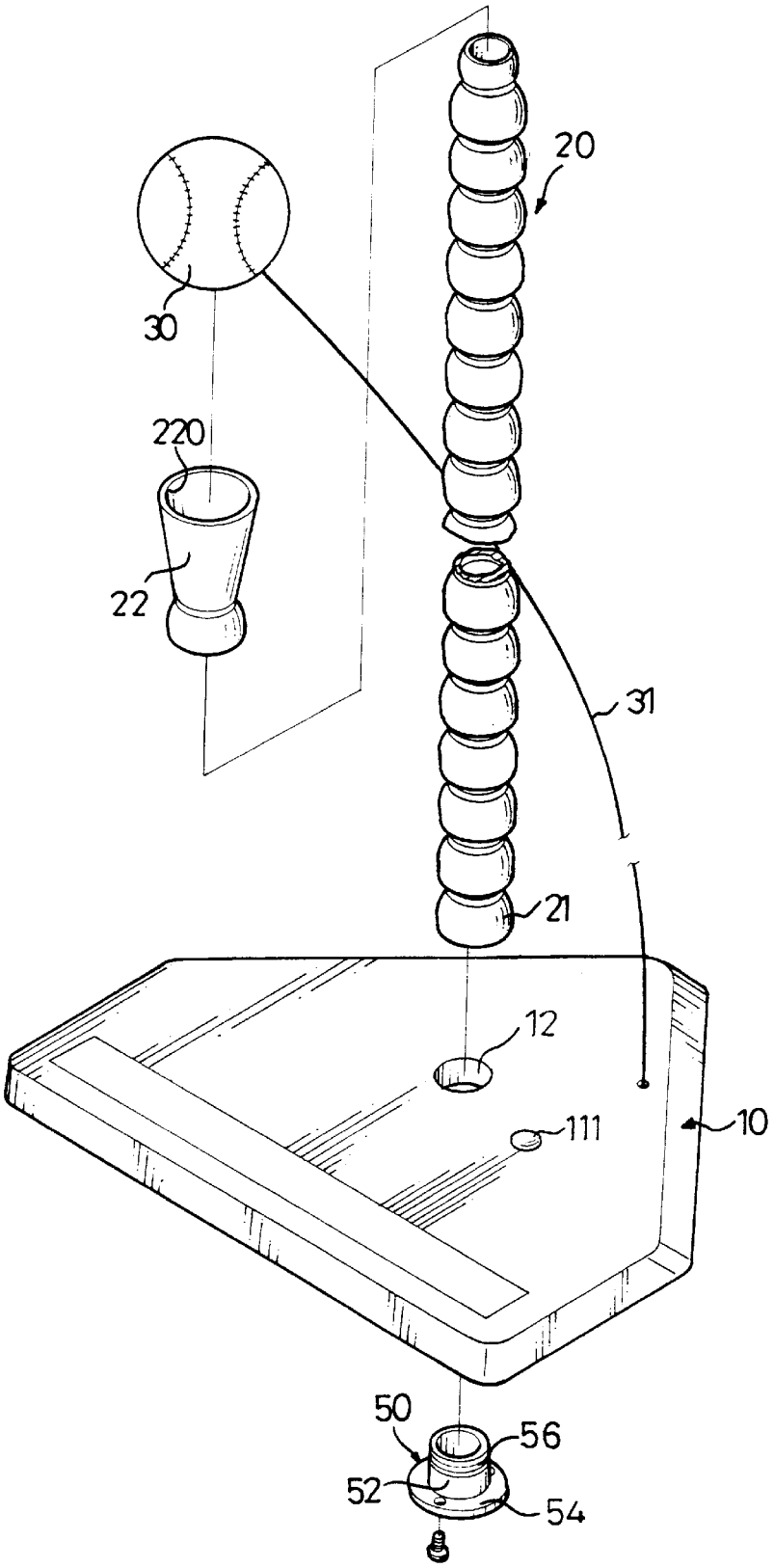
FIG. 2 is an exploded view of FIG. 1.

Referring to FIGS. 2–4 with reference to FIG. 1, the base frame 10 has a passage 12 vertically defined therein. An engaging member 50 is fixedly mounted on an underside of the base frame 10 and has a stub 52 extending through the passage 12 and protruding outward of an upperside of the base frame 10.

The stub 52 is formed with an outer thread 56, and the lower portion 21 of the flexible tube 20 is formed with an inner thread 210 engaged with the outer thread 56 of the stub 52 such that the lower portion 21 of the flexible tube 20 can be fixedly fitted on the upperside of the base frame 10 by means of an threaded engagement with the stub 52 of the engaging member 50.

The base frame 10 has a depression 120 defined in the underside thereof and communicating with the passage 12. The engaging member 50 includes an abutting edge 54 formed on an underside of the stub 52 and received in the depression 120.

A supporting base 22 is fitted on the upper portion of the flexible tube 20, and a socket 220 is defined in a top portion of the supporting base 22 for receiving the baseball 30. A connecting wire 31 includes a first end attached to the upperside of the base frame 10 and a second end attached to the baseball 30.

Preferably, the base frame 10 has a large chamber 11 defined therein, and a hole 110 defined in an upperside thereof and communicating with the chamber 11 such that water or sands can be filled through the hole 110 into the large chamber 11, thereby increasing the weight of the base frame 10.

A plug 111 is detachably fitted on the upperside of the base frame 10 and has a lower portion 112 received in the hole 110, thereby sealing the hole 110.

When being in use, referring to FIGS. 1 and 3, the flexible tube 20 can be disposed in an inclined manner with various inclined angles such that a position of the baseball 30 can be arbitrarily changed by means of adjusting the orientation of the flexible tube 20, thereby increasing the versatility of practicing batting the baseball 30.

It should be clear to those skilled in the art that further embodiments of the present Invention may be made without departing from the spirit and scope of the present invention.

What is claimed is:

1. A batting practice device comprising:

a base frame having upper and lower sides and a vertical passage extending therethrough a chamber defined in said base frame, a hole defined in an upperside of said base frame and communicating with said chamber wereby a fluid weighting material may be placed in said chamber, a plug detachably fitted on the upperside of said base frame and including a lower portion received in said hole; a depression defined in said underside of said base frame and communicating with said passage;

an engaging member fixedly mounted on said base frame and said engaging member being defined by a stub, said stub extending through said passage and protruding outward of said base frame upperside, an outer thread formed on one end of said stub, and a flange formed on the other end of said stub, said flange being received in said depression;

a bellows shaped flexible tube having upper and lower ends; said tube being defined by a plurality of pivot elements, each element having a concave inner surface at one end and a convex outer surface at its other end; said convex outer surface at said one end of each element being in complementary engagement with said concave inner surface at said other end of an adjoining element to define a substantially ball and socked joint; a ball support element pivotally attached at said tube upper end; a ball releasably supported on said ball support element a connecting wire having a first end attached to said base frame and a second end attached to said ball.

2. A batting practice device comprising:

a) a base frame;

b) a target supporting base having a first end and a second end, the second end of the supporting base having a socket adapted to receive a ball; and c) a flexible tube having a lower portion fixedly mounted with the base frame and an upper portion coupled with the first end of the supporting base, the flexible tube including a plurality of elements, each of the plurality of elements of the flexible tube including i) a first end of each element having a convex, partial ball-shaped, outer surface, and ii) a second end of each element having a concave, socket-shaped, inner surface said first end of each element being in complementary engagement with said second end of each adjoining element.

3. The device of claim 2 wherein the first end of an element of the tube fits into the second end of an adjacent element of the tube.

4. The device of claim 2 further comprising d) a target object detachably mounted on the second end of the supporting base.

5. The device of claim 4 further comprising:

e) a connecting wire including a first end attached to the base frame and a second end attached to the target object.

* * * * *